US006761041B2

(12) United States Patent
Roth et al.

(10) Patent No.: US 6,761,041 B2
(45) Date of Patent: Jul. 13, 2004

(54) THERMAL ENERGY STORAGE SYSTEM

(76) Inventors: Henry Roth, 42 Tremont St., Duxbury, MA (US) 02332; Donna Roth, 42 Tremont St., Duxbury, MA (US) 02332

( * ) Notice: Subject to any disclaimer, the term of this patent is extended or adjusted under 35 U.S.C. 154(b) by 0 days.

(21) Appl. No.: 10/361,655

(22) Filed: Feb. 10, 2003

(65) Prior Publication Data

US 2004/0045314 A1 Mar. 11, 2004

Related U.S. Application Data

(63) Continuation-in-part of application No. 10/236,266, filed on Sep. 6, 2002.

(51) Int. Cl.[7] ..... F25D 3/08; F17C 13/00

(52) U.S. Cl. ..... 62/457.2; 62/530; 62/371; 62/457.6; 62/457.7

(58) Field of Search ..... 62/457.2, 457.6, 62/457.7, 371, 530, 457.4, 457.3

(56) References Cited

U.S. PATENT DOCUMENTS

| | | | | | |
|---|---|---|---|---|---|
| 1,551,709 | A | * | 9/1925 | Stoll | 62/315 |
| 1,571,438 | A | * | 2/1926 | Schopf | 62/315 |
| 2,024,648 | A | | 12/1935 | Kissling | |
| 3,413,820 | A | * | 12/1968 | Paquin | 62/371 |
| 3,710,589 | A | * | 1/1973 | Brown et al. | 62/457.2 |
| 4,024,731 | A | | 5/1977 | Branscum | |
| 4,065,336 | A | * | 12/1977 | Conklin | 156/69 |
| 4,249,392 | A | | 2/1981 | Hotta | |
| 4,498,312 | A | * | 2/1985 | Schlosser | 62/457.2 |
| 4,570,454 | A | | 2/1986 | Campbell | |
| 5,050,387 | A | * | 9/1991 | Bruce | 62/60 |
| 5,088,301 | A | * | 2/1992 | Pipenbrink | 62/457.6 |
| 5,177,981 | A | | 1/1993 | Haas | |
| 5,231,850 | A | * | 8/1993 | Morris | 62/457.6 |
| 5,235,819 | A | * | 8/1993 | Bruce | 62/60 |
| 5,329,778 | A | * | 7/1994 | Padamsee | 62/56 |
| 5,345,784 | A | * | 9/1994 | Bazemore et al. | 62/371 |
| D360,105 | S | | 7/1995 | Doxey | |
| 5,520,014 | A | * | 5/1996 | Laugier | 62/457.2 |
| 5,568,735 | A | * | 10/1996 | Newkirk et al. | 62/457.7 |
| 5,701,757 | A | | 12/1997 | Heverly | |
| 5,711,164 | A | | 1/1998 | Slack | |
| D411,741 | S | | 6/1999 | Wilson et al. | |
| 5,992,679 | A | | 11/1999 | Porchia et al. | |
| D420,252 | S | | 2/2000 | Loew et al. | |
| 6,044,650 | A | | 4/2000 | Cook et al. | |
| 6,109,059 | A | | 8/2000 | Lebrun | |
| 6,318,114 | B1 | * | 11/2001 | Slaughter | 62/457.2 |
| 6,557,368 | B1 | * | 5/2003 | DeMars | 62/457.2 |
| 6,601,403 | B1 | * | 8/2003 | Roth et al. | 62/457.2 |

* cited by examiner

*Primary Examiner*—William C. Doerrler
(74) *Attorney, Agent, or Firm*—Volpe and Koenig, P.C.

(57) ABSTRACT

A thermal energy storage container which includes a first panel having a container attachment element located around a periphery thereof. The container attachment element is adapted to engage a complementary lid attachment element. The thermal energy storage container includes a container compartment adapted to store a thermal energy storage material. A thermal energy storage lid which includes a lid attachment element located around a periphery thereof. The lid attachment element is adapted to engage a complementary container attachment element.

37 Claims, 11 Drawing Sheets

THERMAL ENERGY STORAGE SYSTEM

CROSS REFERENCE TO RELATED APPLICATION(S)

This application is a continuation-in-part of and claims priority from U.S. patent application Ser. No. 10/236,266, filed Sep. 6, 2002, entitled "Thermal Storage Lid", which is hereby incorporated by reference herein in its entirety as if fully set forth.

BACKGROUND

The present invention relates to thermal energy storage lids and containers and, more particularly, to lids and containers having a thermal energy storage material located therein.

Thermal energy storage packs are generally known for use in maintaining the contents of a storage container in a heated or cooled state. For example, frozen thermal packs are pre-filled with a thermal energy storage material which can be frozen and then placed alongside food in an insulated container, such as a cooler, in order to maintain the cooler contents, such as food and drinks, in a cold state for a predetermined time period. Such thermal energy materials generally have 10–15 times the thermal capacity of frozen water and therefore maintain the cooler contents in a cold state for an extended period of time in comparison to ice alone. Such cold packs can be reused numerous times by refreezing them between use, and also avoid the problem of melting liquid contacting the items in the cooler. However, it is not always convenient to fit a cold pack in a cooler or other containers in addition to the various food and drinks placed therein.

Energy storage materials which maintain heat are also known which can be preheated in a microwave or through other means, and then placed in a cooler in order to provide heat within the cooler to keep food storage containers in the box warm for a predetermined time period.

These heat or cold packs generally come in predetermined sizes which are not always suitable for use with a particular cooler or box, depending upon the articles or food storage containers also being placed therein.

SUMMARY

One embodiment of the present invention is directed to a thermal energy storage container. The thermal energy storage container includes a first panel having a container attachment element. The first panel defines a recess for receiving food. A second panel is offset from the first panel. The second panel has a peripheral edge connected to the first panel to form a container compartment generally coextensive with the second panel. The container compartment includes a thermal energy storage material.

Another embodiment of the present invention is separately directed to a thermal energy storage container. The thermal energy storage container includes a first panel having a container attachment element. The first panel defines a recess for receiving food. A second panel is offset from the first panel. The second panel has a peripheral edge connected to the first panel to form a container compartment generally coextensive with the second panel. The second panel defines a hole. A tube surrounds the hole and projects away from the container compartment. The tube forms a conduit to allow the insertion of a thermal energy storage material into the container compartment.

Another embodiment of the present invention is separately directed to a method of making a thermal energy storage container. The method includes: providing first and second panels, the first panel including a container attachment element, the second panel being offset from the first panel, the second panel having a peripheral edge connected to the first panel to form a container compartment generally coextensive with the second panel, the second panel further defining a hole and including a tube surrounding the hole and projecting away from the container compartment, the tube forming a conduit to allow the insertion of a thermal energy storage material into the container compartment; inserting a thermal energy storage material into the container compartment through the tube; and closing the tube to seal the container compartment.

Another embodiment of the present invention is separately directed a thermal energy storage lid for a container. The thermal energy storage lid includes a first panel having a lid attachment element. A second panel is offset from the first panel. The second panel is removably connected to the first panel to form a lid compartment generally coextensive with the second panel. A thermal energy storage material for storage is located in a sealed pouch in the lid compartment.

Another embodiment of the present invention is separately directed to a thermal energy storage lid for a container. The thermal energy storage lid includes a first panel having a lid attachment element. A second panel is offset from the first panel. The second panel has a peripheral edge connected to the first panel to form a lid compartment generally coextensive with the second panel. The second panel defines a hole. A tube surrounds the hole and projects away from the lid compartment. The tube forms a conduit to allow the insertion of a thermal energy storage material into the lid compartment.

Another embodiment of the present invention is separately directed to a method of making a thermal energy storage lid for a container. The method includes: providing first and second panels, the first panel having a lid attachment element, the second panel offset from the first panel and having a peripheral edge connected to the first panel to form a lid compartment generally coextensive with the second panel, the second panel defining a hole and including a tube surrounding the hole and projecting away from the lid compartment, the tube forming a conduit to allow the insertion of a thermal energy storage material into the lid compartment; inserting a thermal energy storage material into the lid compartment through the tube; and closing the tube to seal the lid compartment.

Another embodiment of the present invention is separately directed to a thermal energy storage system. The thermal energy storage system includes a thermal energy storage container. The thermal energy storage container includes a first panel having a container attachment element. The first panel defines a recess for receiving food. A second panel is offset from the first panel. The second panel has a peripheral edge connected to the first panel to form a container compartment generally coextensive with the second panel. The container compartment includes a thermal energy storage material. The thermal energy storage system also includes a thermal energy storage lid. The thermal energy storage lid includes a first panel having a lid attachment element. A second panel is offset from the first panel. The second panel has a peripheral edge connected to the first panel to form a lid compartment generally coextensive with the second panel. The lid compartment includes a thermal energy storage material. The thermal energy storage lid is removably attached to the thermal energy storage container.

Another embodiment of the present invention is separately directed to a method of making a thermal energy storage system. The method includes: providing a thermal energy storage container having first and second panels, the second panel being offset from the first panel, the second panel having a peripheral edge connected to the first panel to form a container compartment generally coextensive with the second panel, the second panel further defining a hole and including a tube surrounding the hole and projecting away from the container compartment, the tube forming a conduit to allow the insertion of a thermal energy storage material into the container compartment; inserting a thermal energy storage material into the container compartment through the tube; closing the tube to seal the container compartment; providing a thermal energy storage lid having first and second panels, the first panel including a lid attachment element, the second panel offset from the first panel and having a peripheral edge connected to the first panel to form a lid compartment generally coextensive with the second panel, the second panel defining a hole and including a tube surrounding the hole and projecting away from the lid compartment, the tube forming a conduit to allow the insertion of a thermal energy storage material into the lid compartment; inserting a thermal energy storage material into the lid compartment through the tube; closing the tube to seal the lid compartment; and attaching the thermal energy storage lid to the thermal energy storage container.

Another embodiment of the present invention is separately directed to a set of stacked thermal energy storage containers. The set of stacked thermal energy storage containers includes a plurality of thermal energy storage containers. Each thermal energy storage container is of a proportionately different size. Each thermal energy storage container includes a first panel having a container attachment element. The first panel defines a recess for receiving food. A second panel is offset from the first panel. The second panel has a peripheral edge connected to the first panel to form a container compartment generally coextensive with the second panel. The container compartment includes a thermal energy storage material. The plurality of thermal energy storage containers are concentrically stacked together.

Another embodiment of the present invention is separately directed to a method for making a set of stacked thermal energy storage containers. The method includes: providing a plurality of thermal energy storage containers, wherein each thermal energy storage container is of a proportionately different size; each thermal energy storage container including first and second panels, the first panel including a container attachment element, the second panel being offset from the first panel, the second panel having a peripheral edge connected to the first panel to form a container compartment generally coextensive with the second panel, the second panel further defining a hole and including a tube surrounding the hole and projecting away from the container compartment, the tube forming a conduit to allow the insertion of a thermal energy storage material into the container compartment; inserting a thermal energy storage material into the container compartment through the tube; closing the tube to seal the container compartment; and concentrically stacking the plurality of thermal energy storage containers together.

Another embodiment of the present invention is separately directed to a method for maintaining a consumable product at a desired temperature for a desired amount of time. The method including: providing a plurality of thermal energy storage containers, wherein each thermal energy storage container is of a proportionately different size; each thermal energy storage container including first and second panels, the second panel being offset from the first panel, the first panel including a container attachment element, the second panel having a peripheral edge connected to the first panel to form a container compartment generally coextensive with the second panel, the container compartment including a thermal energy storage material; concentrically stacking the plurality of thermal energy storage containers, the number of thermal energy storage containers in the stack depending on the desired time period for which the desired temperature is to be maintained within the innermost thermal energy storage container; providing a thermal energy storage lid having first and second panels, the first panel including a lid attachment element, the second panel offset from the first panel and having a peripheral edge connected to the first panel to form a lid compartment generally coextensive with the second panel, the lid compartment including a thermal energy storage material; and attaching a thermal energy storage lid to the innermost thermal energy storage container in the set of stacked thermal energy storage containers.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
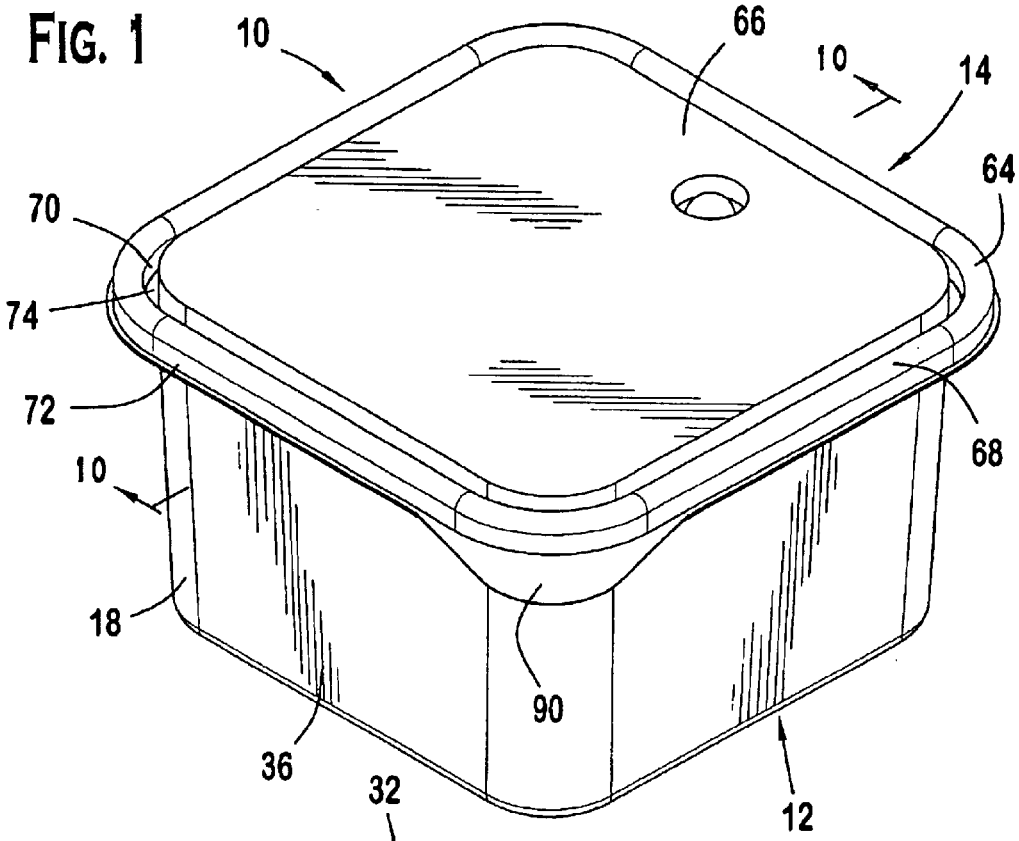
FIG. 1 is a perspective view of a thermal energy storage container and thermal energy storage lid, according to a preferred embodiment of the present invention, both the container and lid are preferably filled with a thermal energy storage material.
Figure 2:
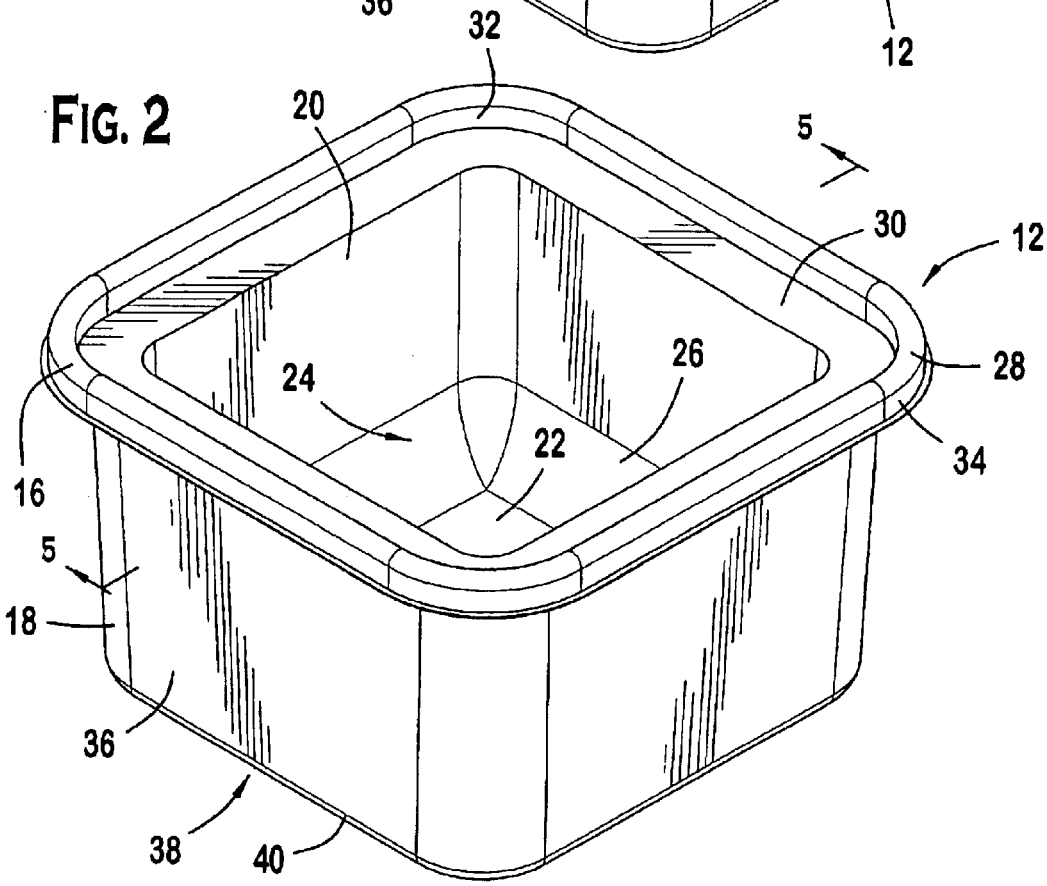
FIG. 2 is a perspective view of the thermal energy storage container of FIG. 1.
Figure 3:
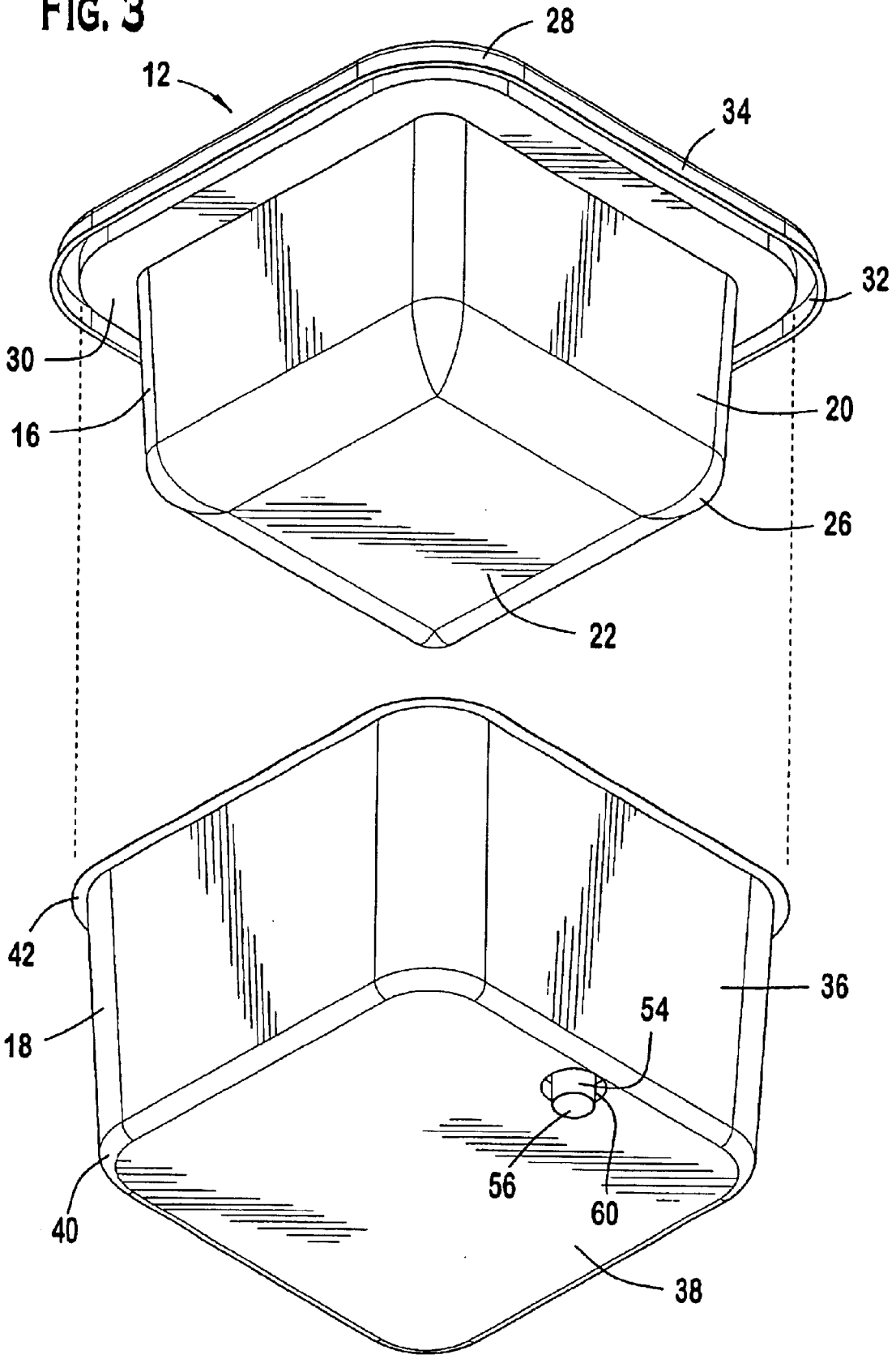
FIG. 3 is an exploded perspective view of the thermal energy storage container of FIG. 1 without any thermal energy storage material therein.

Certain terminology is used in the following description for convenience only and is not limiting. The words "right," "left," "top," and "bottom" designate directions in, the drawings to which reference is made. The words "inwardly" and "outwardly" refer to directions toward and away from, respectively, the geometric center of the thermal energy storage container and lid and designated parts thereof. The words "a" and "one" are defined as including one or more of the referenced item unless specifically stated otherwise. This terminology includes the words above specifically mentioned, derivatives thereof, and words of similar import.

Referring to FIGS. 1–17, wherein like numerals indicate like elements throughout, the preferred embodiments of a thermal energy storage container 12 and thermal energy storage lid 14 according to the present invention are shown. Briefly stated, the thermal energy storage container 12 and lid 14 are adapted to maintain a consumable product within an acceptable temperature range for a desired period of time. To optimize the heating or cooling effect of the container 12 and lid 14, the container 12 and lid 14 preferably include first and second panels 16, 64, 18, 66 forming a container compartment 44 and lid compartment 76 wherein a thermal energy storage material 46, 78 is located.

As shown in FIG. 1, the present invention relates to a thermal energy storage system 10 comprised of a thermal energy storage container 12 and a thermal energy storage lid 14. The container 12 and lid 14 can be used alone or in combination. The container 12 and lid 14 are preferably made of a polymeric material, such as polyethylene terephthalate (PET), polyvinyl chloride (PVC), polyphthalate carbonate (PPC) or any other suitable material. The container 12 and complementary lid 14 are preferably in the shape of a cube, cylinder, or rectangular prism or any other suitable shape.

Referring now to FIGS. 2–5, the thermal energy storage container 12 is shown. The container 12 includes first and second panels 16, 18. The first, inner panel 16 includes a side wall 20 and a base wall 22, generally defining a recess 24 for storing food or any other substance. A smoothly curved base edge 26 preferably transitions the side wall 20 to the base wall 22. The first panel 16 of the container 12 preferably includes a container attachment element 28 extending from a peripheral collar 30 thereof. The container attachment element 28, which is shown in more detail in FIGS. 4 and 5, includes inner and outer legs 32, 34 preferably forming a U-shape.

The second, outer panel 18 of the thermal energy storage container 12 is generally offset from the first panel 16 and includes a side wall 36 and a base wall 38. A rigidly curved base edge 40 preferably transitions the side wall 36 to the base wall 38. The second panel 18 preferably includes a peripheral edge 42 connected to the first panel 16 to form a container compartment 44 that is generally coextensive with the second panel 18. The peripheral edge 42 of the second panel 18 is preferably heat sealed or sonic welded to the peripheral collar 30 of the first panel 16. However, any other known suitable connecting methods, such as an adhesive or a solvent weld may also be utilized.

Figure 14:
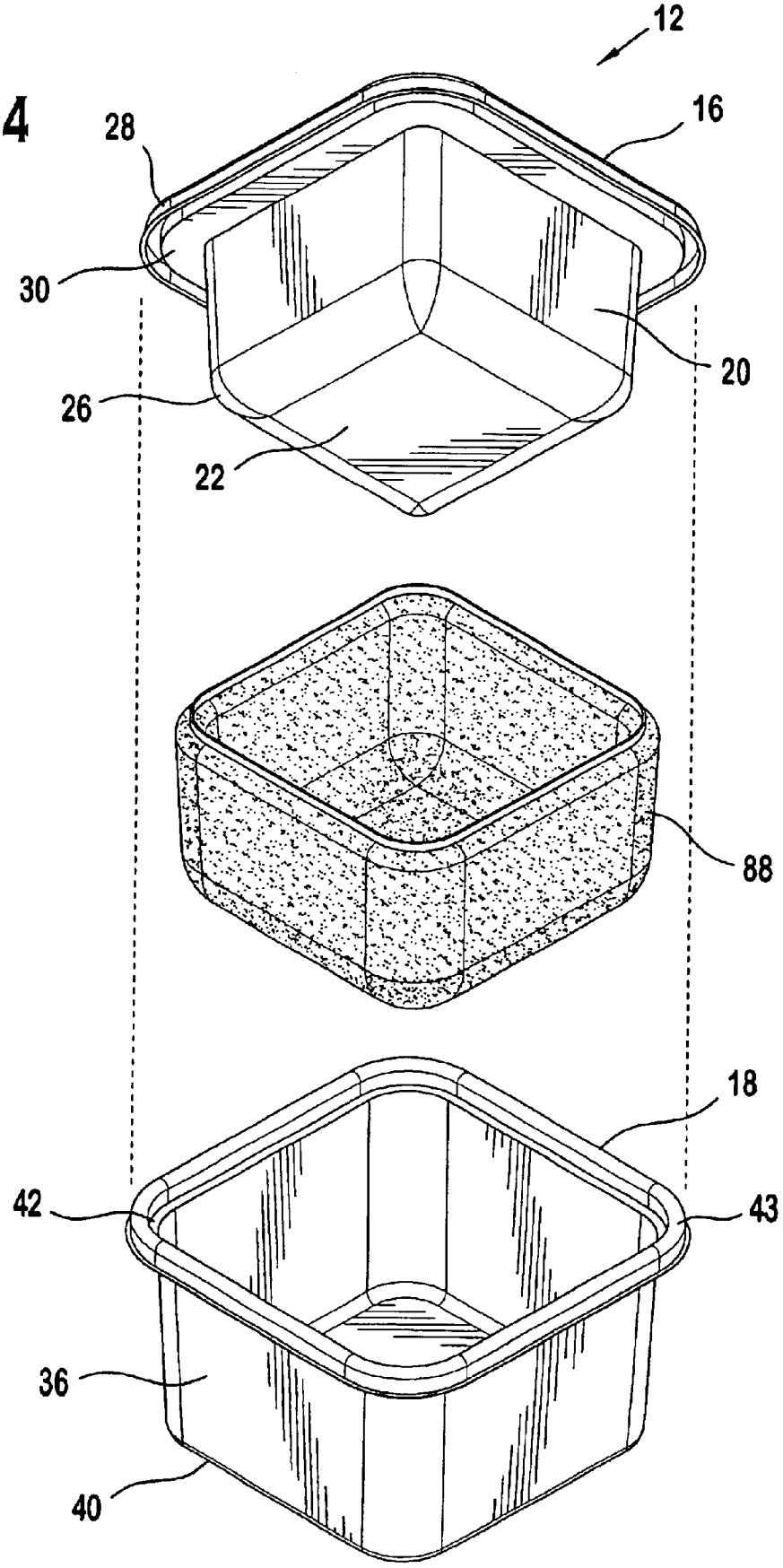
FIG. 14 is an exploded perspective view of the thermal energy storage container of FIG. 1, illustrating the thermal energy storage material located in a sealed, formed pouch.

Additionally, as shown in FIG. 14, the peripheral edge 42 of the second panel 18 may be removably connected to the container attachment element 28 of the first panel 16. For example, as shown in FIG. 14, the peripheral edge 42 can include a container compartment attachment element 43 which is preferably U-shaped and forms an interference friction fit with the container attachment element 28.

Figure 5:
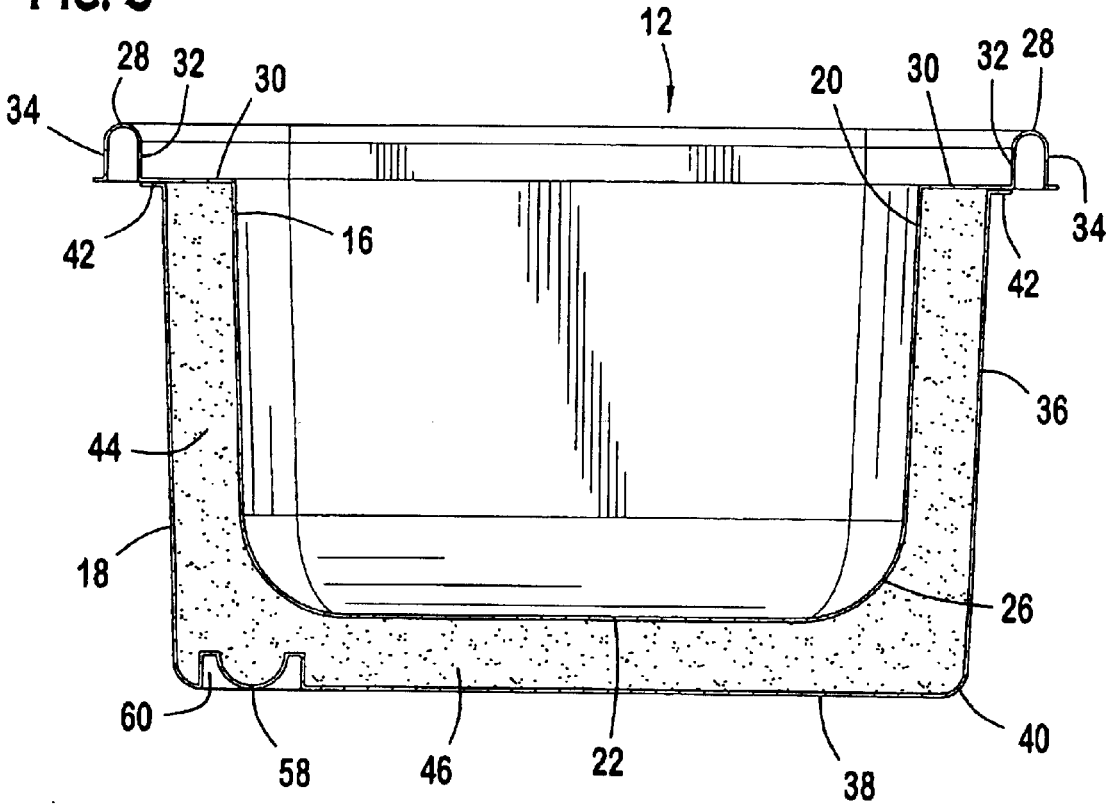
FIG. 5 is a cross-sectional view of the thermal energy storage container of FIG. 2 as taken along the line 5—5 of FIG. 2.
Figure 6:
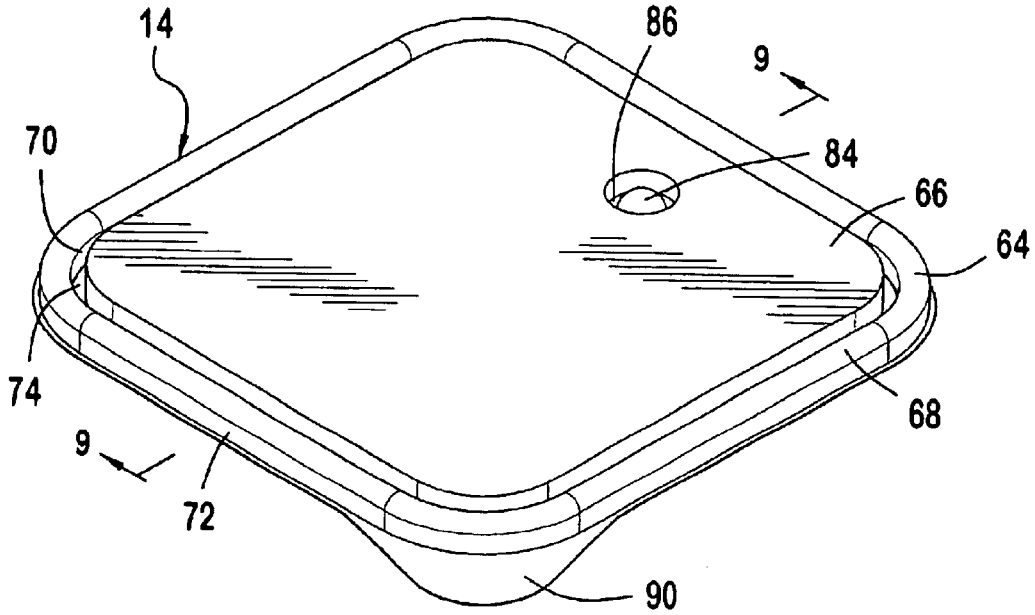
FIG. 6 is a perspective view of the thermal energy storage lid of FIG. 1.
Figure 7:
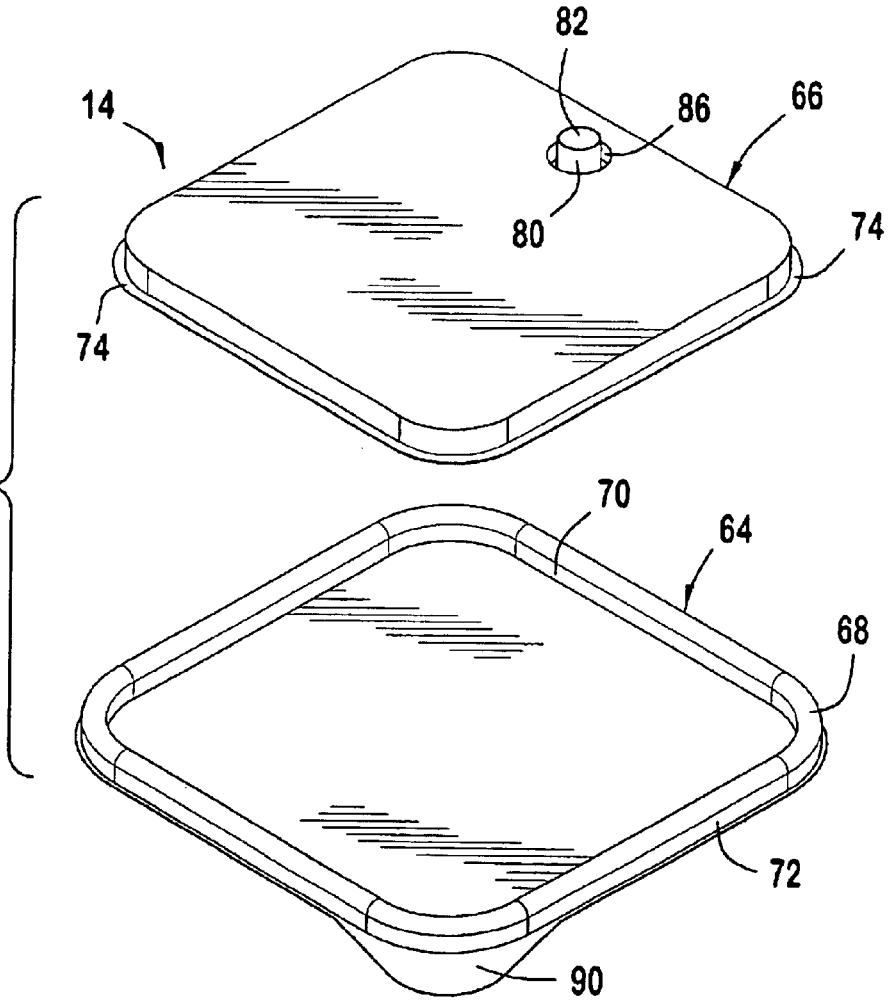
FIG. 7 is an exploded perspective view of the thermal energy storage lid of FIG. 1 without any thermal energy storage material located therein.

As shown in FIG. 5, a thermal energy storage material 46 is preferably located in the container compartment 44. In the embodiment shown in FIG. 5 the thermal energy storage material 46 is located directly between the first panel 16 and the second panel 18. To prevent leakage, the peripheral edge 42 of the second panel 18 is preferably sealed to the peripheral collar 30 of the first panel.

Figure 4:
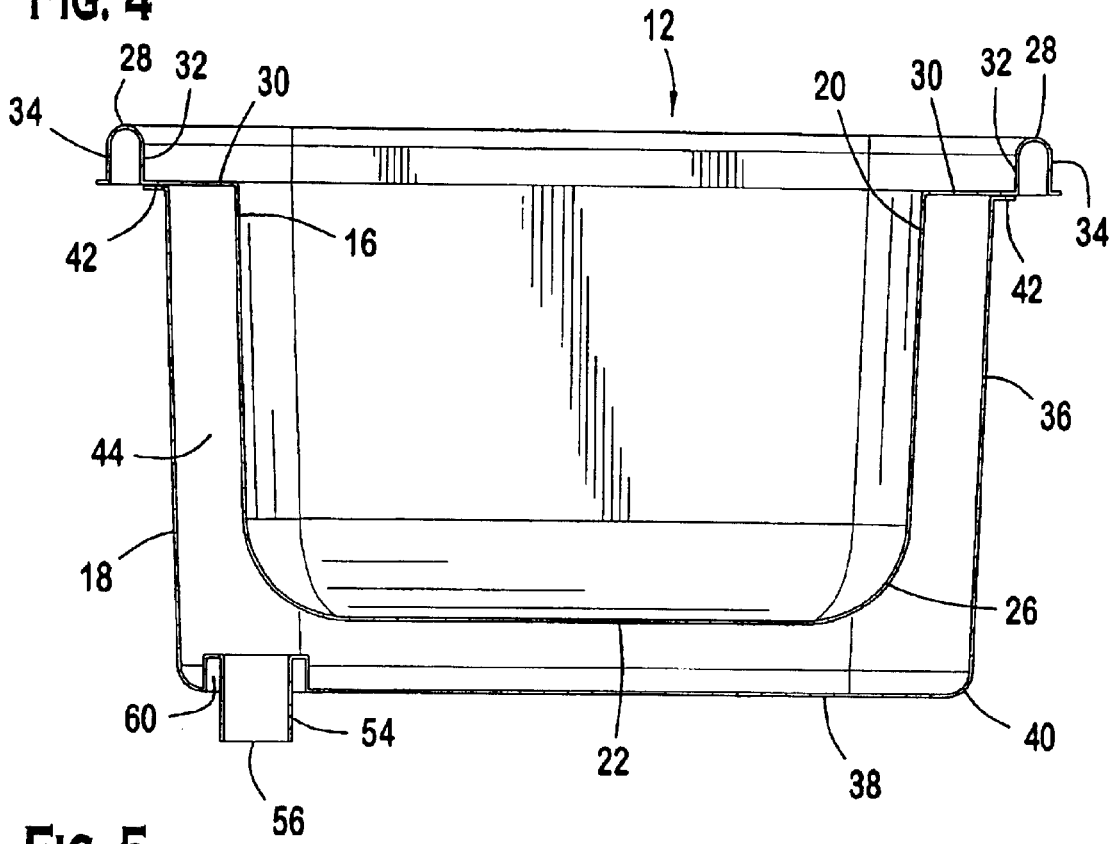
FIG. 4 is a cross-sectional view of the thermal energy storage container of FIG. 1 without any thermal energy storage material therein.

As shown in FIG. 4, the thermal energy storage material 46 can also be inserted into the container compartment 44 through a tube 54 surrounding a hole 56 in the second panel 18 and projecting away from the container compartment 44. After insertion of the thermal energy storage material 46 into the container compartment 44, the tube 54 is preferably closed to seal the container compartment (see FIG. 5). The tube 54 can be closed by heat sealing the tube 54 or sonic welding the tube 54 or any other means of closing the tube 54. As shown in FIG. 5, after sealing the container compartment 44, the tube 54 is preferably melted and pushed into a recessed portion 60 of the second panel 18. By pushing the tube 54 into the recessed portion 60, the tube 54 spreads out forming a protrusion 58 (stated as a sealed tube in the claims) in the recessed portion 60 of the second panel 18 that is preferably level with the second panel 18.

In the container embodiment shown in FIGS. 14–17, the thermal energy storage material 46 is preferably located in one or more sealed pouches 62 that are placed in the container compartment 44. In this embodiment, the peripheral edge 42 of the second panel 18 may be removably connected to the container attachment element 28 of the first panel 16. For example, the peripheral edge 42 can include a container compartment attachment element 43 which is preferably U-shaped and forms an interference friction fit with the container attachment element 28.

Figure 15:
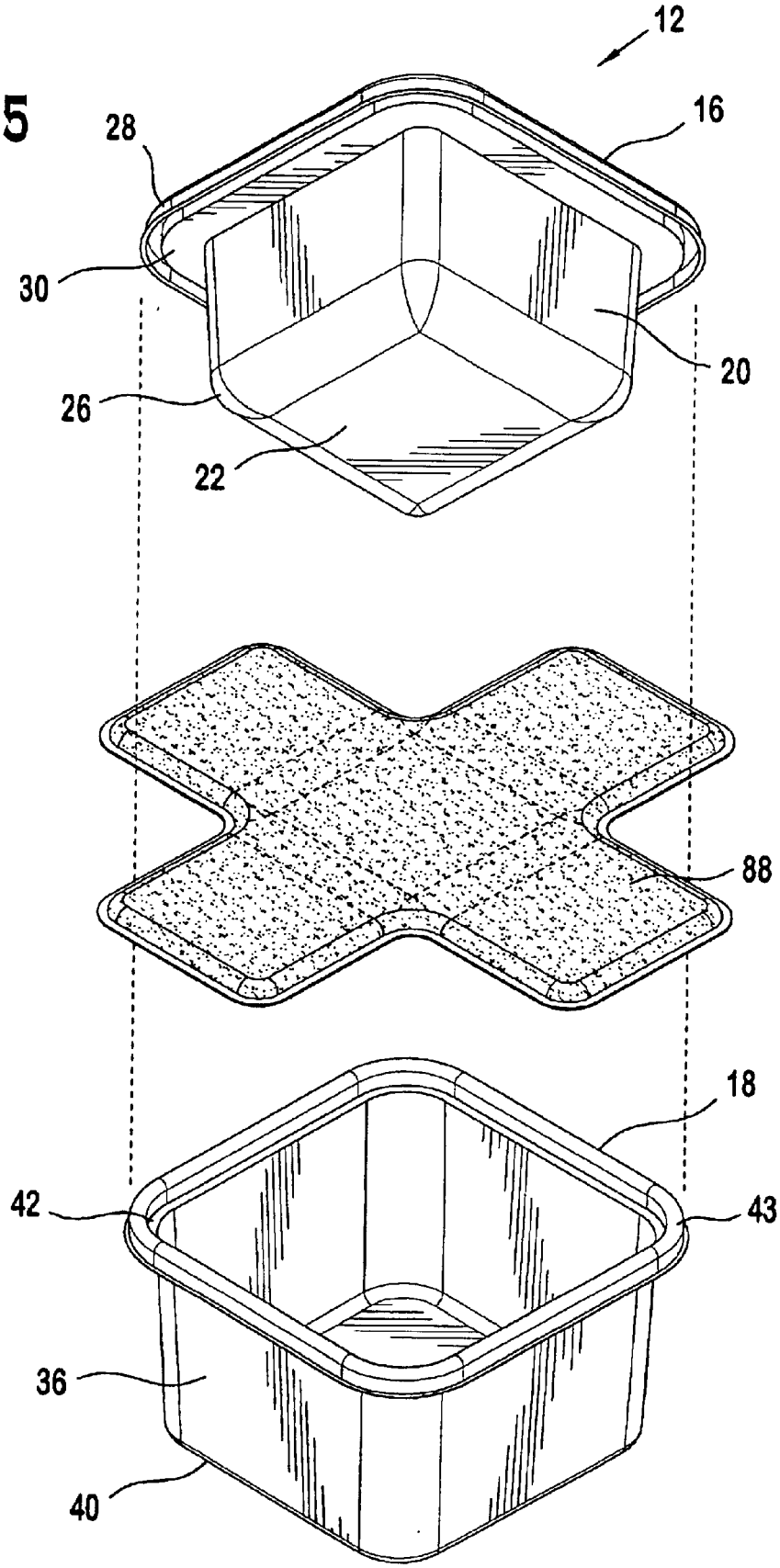
FIG. 15 is an exploded perspective view of the thermal energy storage container of FIG. 1, illustrating the thermal energy storage material located in a sealed pouch having folding seams.
Figure 16:
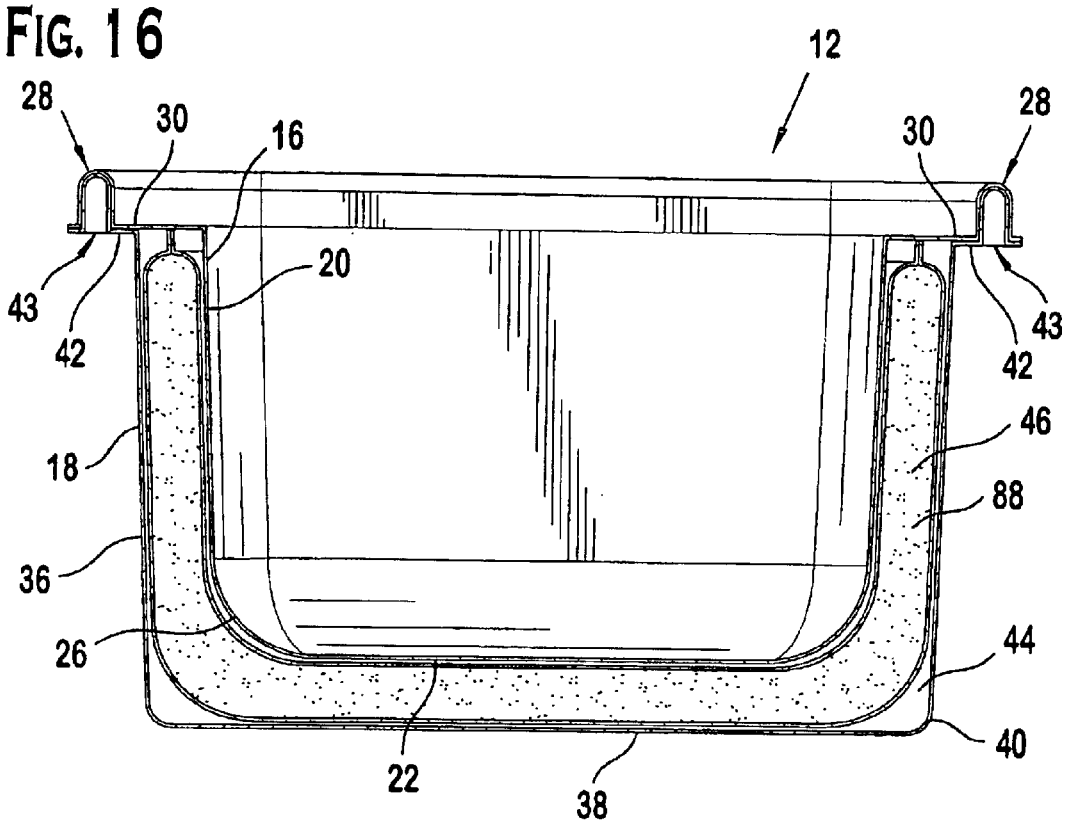
FIG. 16 is a cross-sectional view of the thermal energy storage container of FIG. 14.
Figure 17:
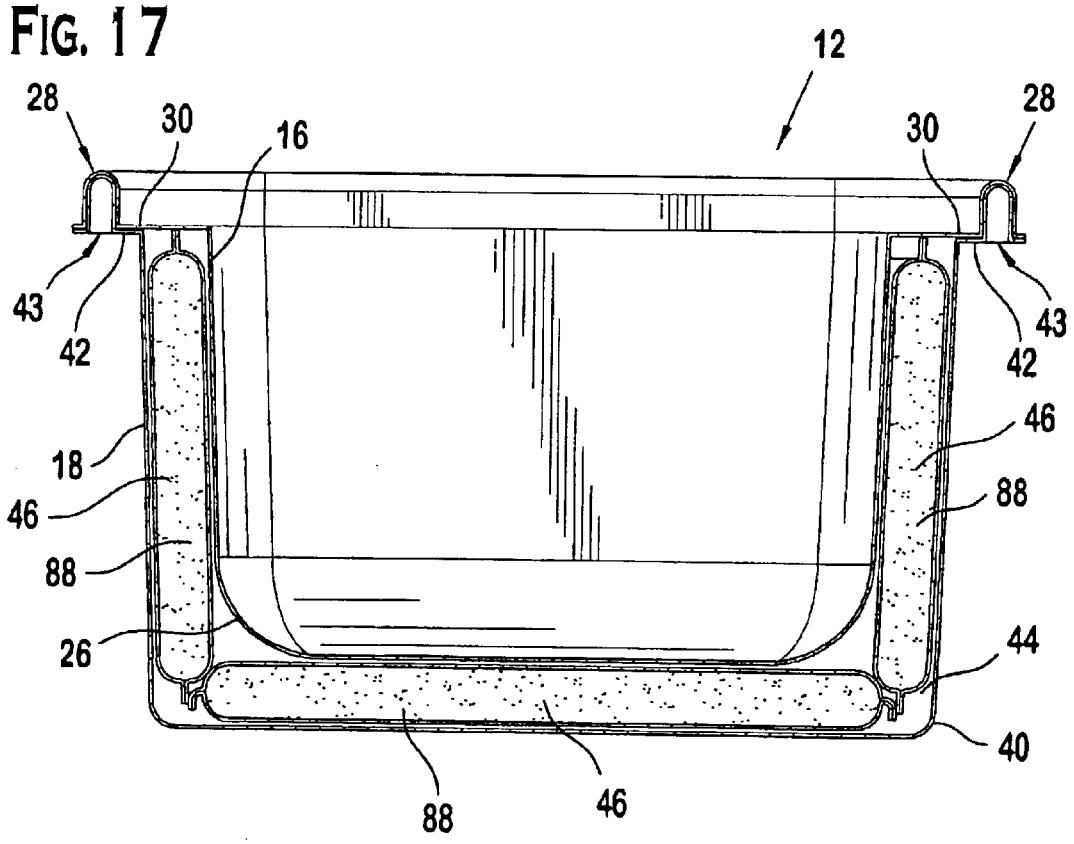
FIG. 17 is a cross-sectional view of the thermal energy storage container of FIG. 1, illustrating the thermal energy storage material located in at least two sealed pouches.

As shown in FIGS. 14–15, the thermal energy storage material 46 can be located in a single sealed pouch 62 that is formed in the shape of the container compartment 44. As shown in FIG. 16, the thermal energy storage material 46 can also be located in a single sealed pouch 62 that is in the shape of a cross having four seams, wherein the pouch 62 can fold up to fit within the container compartment 44. Additionally, as shown in FIG. 17, the thermal energy storage material 46 can be located in one or more sealed pouches 62 in the container compartment 44.

Referring now to FIGS. 6–9, the thermal energy storage lid 14 preferably includes a first panel 64 and a second panel 66. The first panel 64 preferably includes a lid attachment element 68 located around a periphery thereof. The attachment element 68, which is shown in more detail in FIGS. 10 and 11, preferably has an inner leg 70 and an outer leg 72 which form a U-shape that is complementary to the container attachment element 28. The second panel 66 is offset from the first panel 64 and includes a peripheral edge 74 which is connected to an extended portion 73 of the first panel 64 to form a lid compartment 76 that is generally coextensive with the second panel 66. Preferably, the second panel 66 is heat sealed or sonic welded to the extended portion 73 of the first panel 64. However, any other known suitable connecting methods, such as adhesive or a solvent weld may also be utilized.

Figure 8:
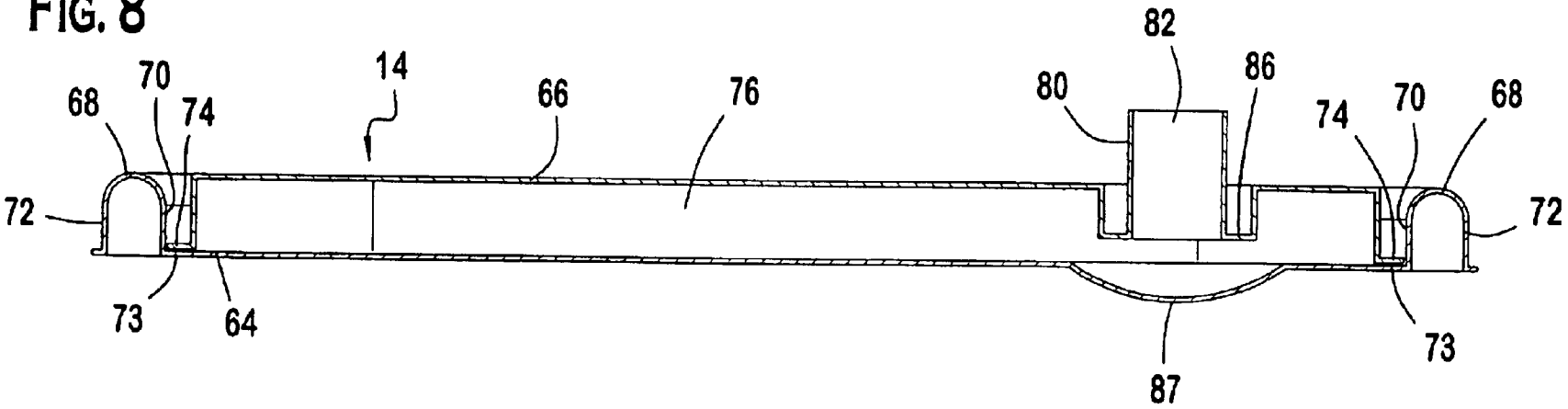
FIG. 8 is a cross-sectional view of the thermal energy storage lid of FIG. 1 without any thermal energy storage material located therein.
Figure 9:
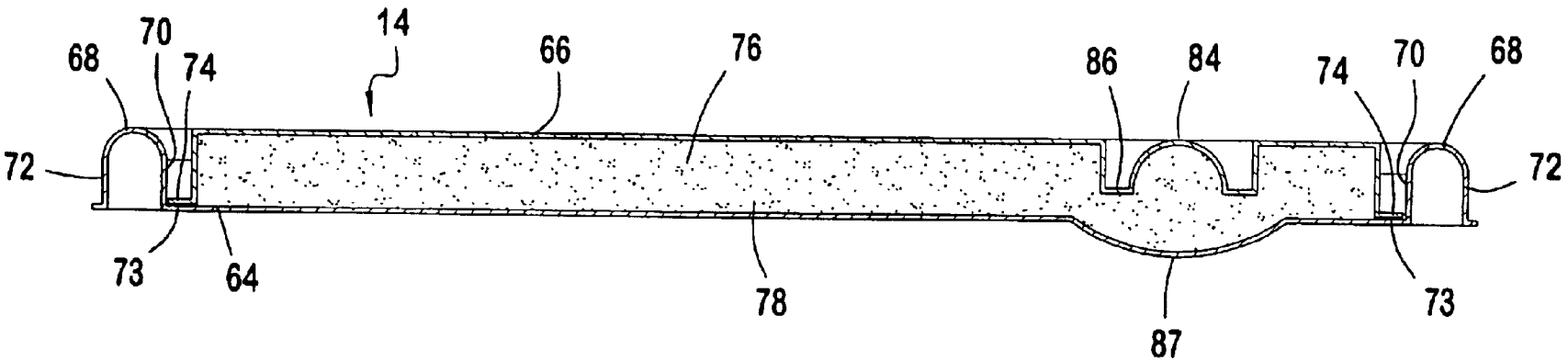
FIG. 9 is a cross-sectional view of the thermal energy storage lid of FIG. 6 as taken along the line 9—9 of FIG. 6.

A thermal energy storage material 78 is preferably located in the lid compartment 76. As shown in FIG. 8, the thermal energy storage material 78 is inserted into the lid compartment 76 through a tube 80 that surrounds a hole 82 in the second panel 66 and projects away from the lid compartment 76. After the thermal energy storage material is inserted into the compartment 76 the tube 80 is closed to seal the lid compartment 76. Preferably, the tube 80 is closed by heat sealing the tube 80 or sonic welding the tube 80 or any other known method of closing the tube 80. After sealing the lid compartment 76, the tube 80 is preferably melted and pushed into a recessed portion 86 of the second panel 66. By pushing the tube 80 into the recessed portion 86, the tube 80 spreads out forming a protrusion 84 (stated as a sealed tube in the claims) in the recessed portion 86 of the second panel 66 that is level with the second panel 66. In addition, a protrusion 87 can be formed on the first panel 64, generally opposite from the protrusion 84 in the recessed portion 86 of the second panel 66, due to the tube 80 being pushed into the lid compartment 76.

In an alterative embodiment, the thermal energy storage material 78 can be located in a sealed pouch 88 that is removably placed in the lid compartment 76. In this embodiment, the peripheral edge 74 is removably connected to the lid attachment element 68 of the first panel 64 to permit removal of the sealed pouch 88. For example, the peripheral edge 42 can include a lid compartment attachment element (not shown) which is preferably U-shaped and forms an interference friction fit with the lid attachment element 68.

Figure 10:
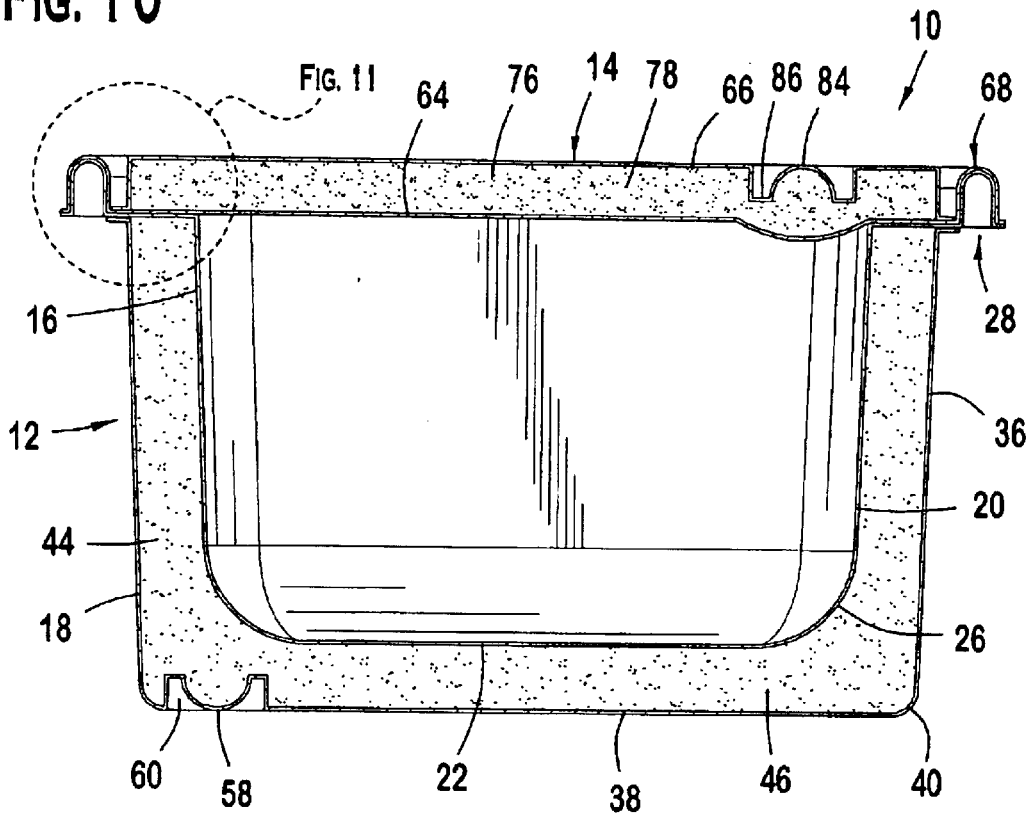
FIG. 10 is a cross-sectional view of the thermal energy storage container and thermal energy storage lid of FIG. 1 as taken along the line 10—10 of FIG. 1.
Figure 11:
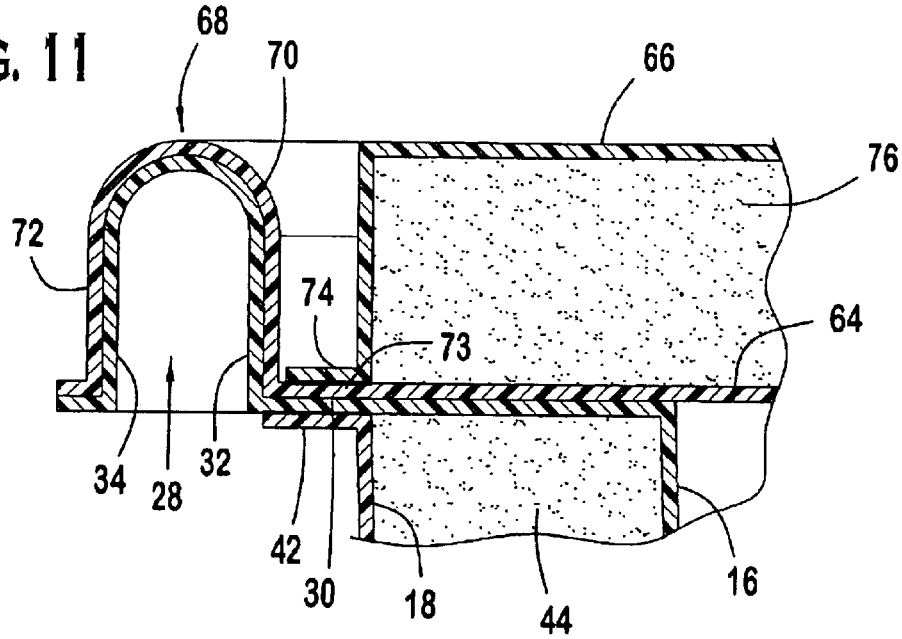
FIG. 11 is an enlarged partial cross-sectional view of an attachment element of the thermal energy storage container and thermal energy storage lid of FIG. 10 as enclosed within the dotted segment of FIG. 10.

As shown in FIGS. 10 and 11, the lid attachment element 68 preferably overlays the container attachment element 28 when the lid 14 is attached to the container 12. The lid attachment element 68 is preferably flexible to form an interference friction fit with the more rigid container attachment element 28. The interference friction fit forms a tight attachment between the lid 14 and the container 12. A handle 90 preferably extends from the outer leg 72 of the lid attachment element 68 to simplify the removal of the lid 14 from the container 12.

In a preferred embodiment, as shown in FIG. 10, the thermal energy storage material 46, 78 located in the container 12 and the lid 14 is in the form of a gel which can undergo repeated cycles of freezing and thawing in order to provide a cold storage container 12 or lid 14. Heat storing materials may also be utilized such that the container 12 or the lid 14 can be placed in a microwave oven to heat the thermal energy storage material 46, 78 in order to keep the container contents warm.

To maintain a desired temperature within the thermal energy storage container 12, the distance between the first and second panels 16, 18 can vary within the container compartment 44. For example, in order to account for the heat transfer due to handling of the container at the side wall 36 of the second panel 18, the orthogonal distance between the first and second panels 16, 18 at the side wall of the first and second panels 20, 36 can be increased to permit a greater volume of the thermal energy storage material 46 to fill that particular portion of the container compartment 44.

Figure 12:
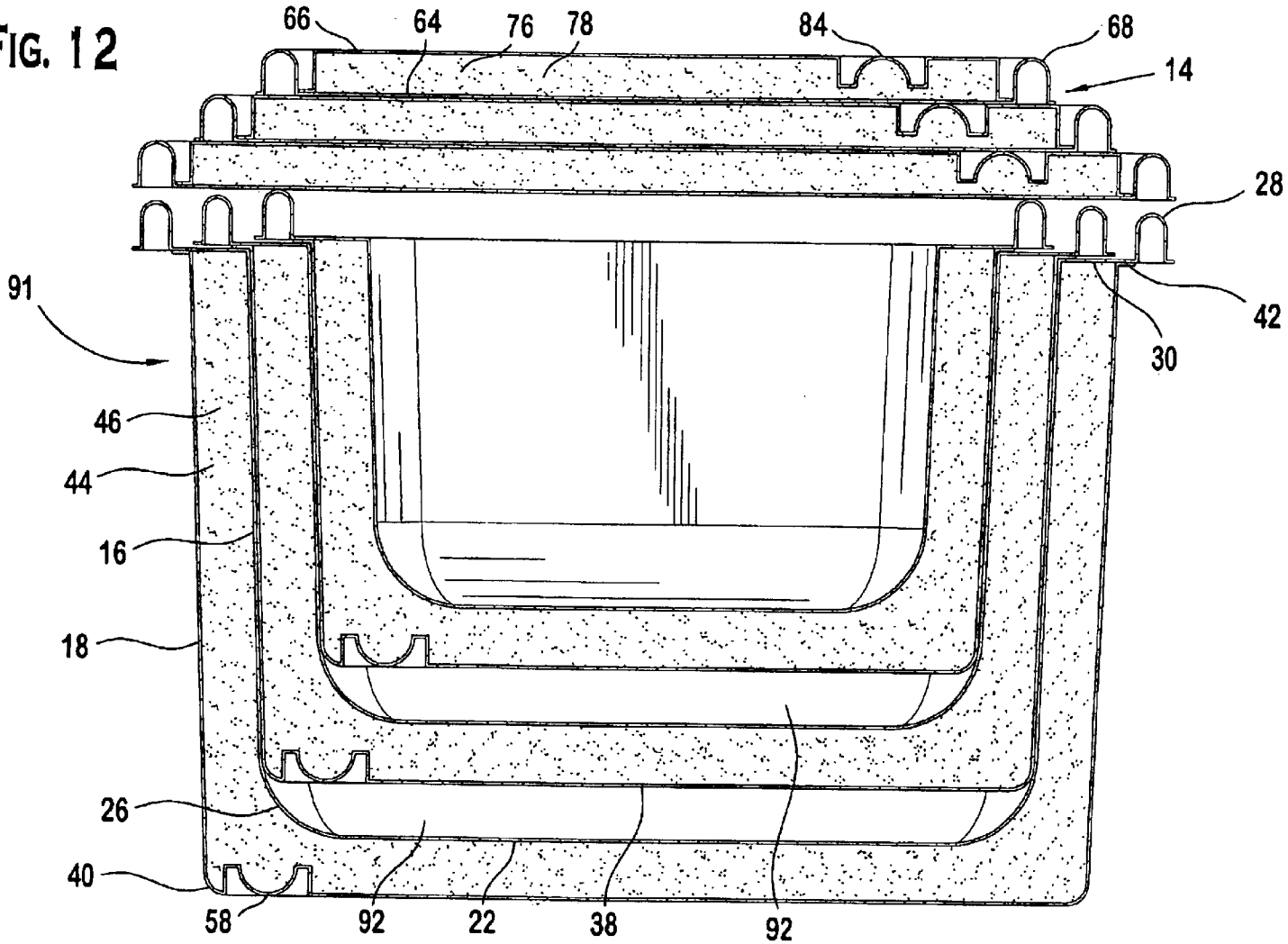
FIG. 12 is a cross-sectional view of a set of stacked thermal energy storage containers and stacked thermal energy storage lids, both the set of stacked thermal energy storage containers and lids are preferably filled with a thermal energy storage material.
Figure 13:
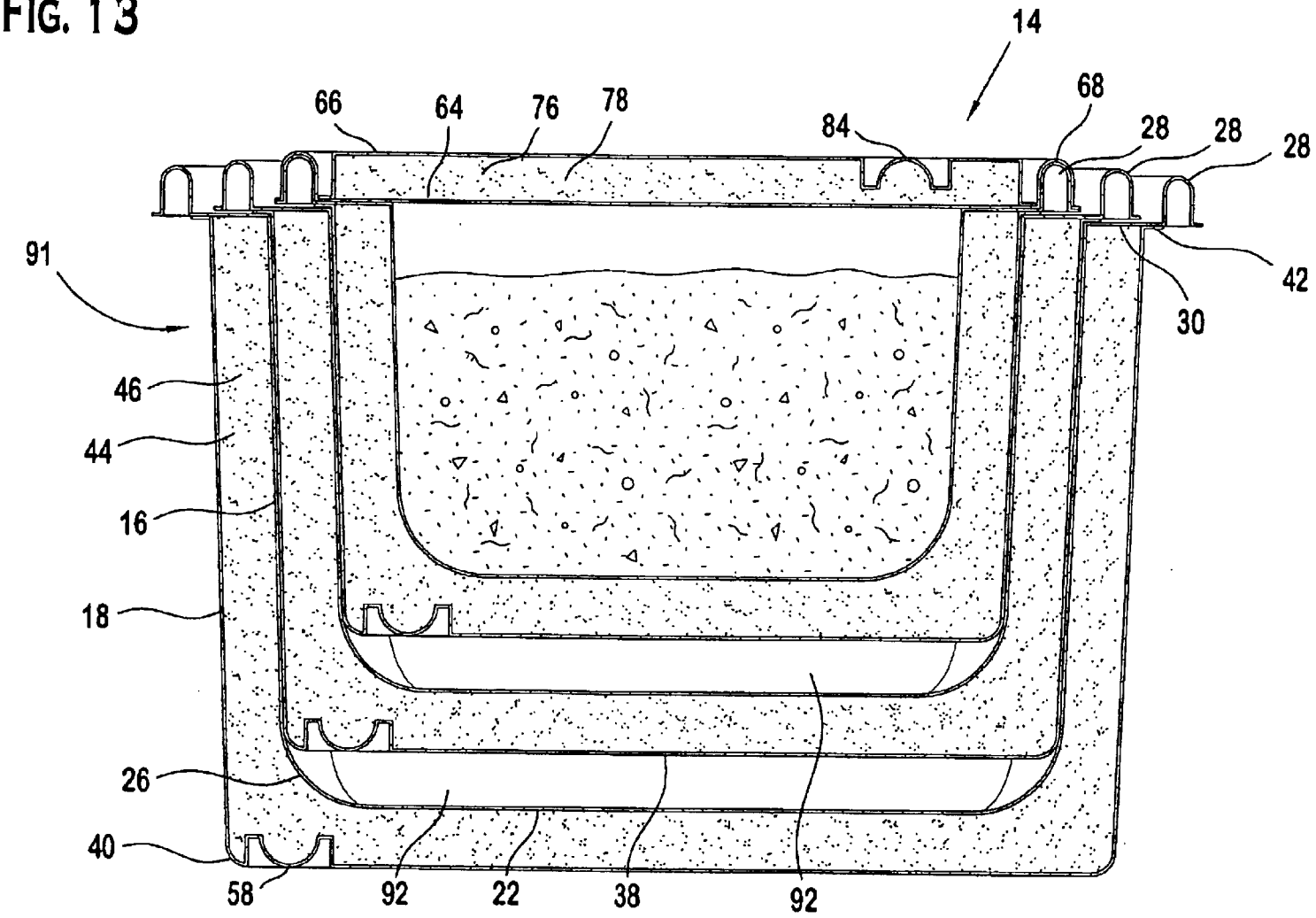
FIG. 13 is a cross-sectional view of a set of stacked thermal energy storage containers and a thermal energy storage lid, both the set of stacked thermal energy storage containers and lid are preferably filled with a thermal energy storage material.

Referring now to FIGS. 12 and 13, a set of stacked thermal energy storage containers 91 is shown. The set of stacked thermal energy containers 91 include a plurality of thermal energy storage containers 12. Each thermal energy storage container 12 is preferably of a proportionately different size. The plurality of thermal energy storage containers 12 can be concentrically stacked together.

Preferably, to assist stacking of the containers 12, the smoothly curved peripheral base edge 26 of the first panel 16 of the container 12 is adapted to support the rigidly curved peripheral base edge 40 of second panel 18 of the inserted, adjacent thermal energy storage container 12. It is preferred that an insulating air barrier 92 is formed between the base wall 22 of the first panel 16 of the supporting thermal energy storage container 12 and the base wall 38 of the second panel 18 of the inserted, adjacent thermal energy storage container 12.

Additionally, as shown in FIGS. 12 and 13, to assist stacking of the containers, the peripheral collar 30 of the first panel 16 of each of the thermal energy storage container 12 is adapted to support the peripheral edge 42 of the second panel 18 of the inserted, adjacent thermal energy storage containers 12.

As shown in FIG. 13, a consumable product can be maintained at a desired temperature for a desired amount of time by concentrically stacking a plurality of thermal energy storage containers 12. The appropriate number of thermal energy storage containers 12 in the stack 91 depends on the desired time period for which the desired temperature is to be maintained within the innermost thermal energy storage container 12 holding the consumable product. In addition, a thermal energy storage lid 14 can be attached to the innermost thermal energy storage container 12 in the set of stacked thermal energy storage containers 91 to optimize the heating or cooling effect.

Referring now to FIGS. 1–5, one embodiment of the present invention operates as follows. The container 12 is charged with thermal energy, such as by placing it in a freezer to cool the thermal energy storage material 46 or by placing it in a microwave and heating it to charge the thermal energy storage material 46 with heat energy. The user may insert food or any other substance Into the recess 24 of the container 12. The lid 14 is then snapped onto the container 12 by engaging the lid attachment element 68 with the complementary container attachment element 28. For cooling applications, the container 12 is cooled via heat energy from the contents of the container 12 being absorbed by the thermal energy storage material 46 in order to maintain the contents of the container 12 in a cooled state. For heating applications, the thermal energy storage material 46 radiates heat which maintains the contents of the container 12 in a heated condition.

While various shapes, configurations, and features have been described above and shown in the drawings for the various embodiments of the present invention, those of ordinary skill in the art will appreciate from this disclosure that any combination of the above features can be used without departing from the scope of the present invention.

Accordingly, it is recognized by those skilled in the art that changes may be made to the above described embodiments of the invention without departing from the broad inventive concept thereof. It is understood, therefore, that this invention is not limited to the particular embodiments disclosed, but is intended to cover all modifications which are within the spirit and scope of the invention as defined by the appended claims and/or shown in the attached drawings.

What is claimed is:

1. A thermal energy storage container, comprising:

a first panel having a container attachment element, the first panel defining a recess for receiving food;

a second panel, offset from the first panel, having a peripheral edge connected to the first panel to form a container compartment generally coextensive with the second panel, the first and second panels being formed by a polymer and being nondetachably fixed to each other, wherein the first and second panels are translucent; and a thermal energy storage material sealed within the container compartment, wherein the thermal energy storage material has a color so that the thermal energy storage container generally has the color of the thermal energy storage material.

2. The thermal energy storage container of claim 1, wherein the second panel includes a sealed tube located in a recessed portion.

3. The thermal energy storage container of claim 1, wherein the peripheral edge of the second panel is sealed to a peripheral collar of the first panel.

4. The thermal energy storage container of claim 3, wherein the container attachment element is generally U-shaped.

5. The thermal energy storage container of claim 1, wherein the thermal energy storage material is a gel.

6. The thermal energy storage container of claim 1, wherein the orthogonal distance between the first and second panels varies within the container compartment.

7. A thermal energy storage container, comprising:

a first panel having a container attachment element, the first panel defining a recess for receiving food;

a second panel, offset from the first panel, having a peripheral edge connected to the first panel to form a container compartment generally coextensive with the second panel, the second panel defining a hole, the first and second panels being formed by a polymer and being nondetachably fixed to each other, wherein the first and second panels are translucent; and a tube surrounding the hole and projecting away from the container compartment, the tube forming a conduit to allow the insertion of a thermal energy storage material into the container compartment, the tube being permanently closed after the tube is sealed.

8. The thermal energy storage container of claim 7, wherein the peripheral edge of the second panel is sealed to a peripheral, collar of the first panel.

9. The thermal energy storage container of claim 7, wherein the container attachment element is generally U-shaped.

10. The thermal energy storage container of claim 7, wherein the thermal energy storage material is a gel.

11. The thermal energy storage container of claim 7, wherein the orthogonal distance between the first and second panels varies within the container compartment.

12. A method of making a thermal energy storage container, comprising:

providing first and second panels, the first panel including a container attachment element, the second panel being offset from the first panel, the second panel having a peripheral edge connected to the first panel to form a container compartment generally coextensive with the second panel, the first and second panels being formed by a polymer, wherein the first and second panels are translucent, the second panel further defining a hole and including a tube surrounding the hole and projecting away from the container compartment, the tube forming a conduit to allow the insertion of a thermal energy storage material into the container compartment;

sealing the first and second panels to each other;

inserting a thermal energy storage material into the container compartment through the tube, the thermal energy storage material being colored; and permanently closing the tube to seal the container compartment, wherein the thermal energy storage container generally has the color of the thermal energy storage material.

13. The method of claim 12, wherein the step of closing the tube further comprises heat sealing the tube.

14. The method of claim 12, wherein the step of closing the tube further comprises sonic welding the tube.

15. The method of claim 12, wherein the orthogonal distance between the first and second panels varies within the container compartment.

16. A thermal energy storage lid for a container, comprising:

a first panel having a lid attachment element;

a second panel, offset from the first panel, that is removably connected to the first panel to form a lid compartment generally coextensive with the second panel; and a thermal energy storage material for storage located in a sealed pouch in the lid compartment, wherein the sealed pouch has a plurality of folding seams which generally form a polygon.

17. The thermal energy storage lid of claim 16, wherein the lid attachment element is generally U-shaped.

18. The thermal energy storage lid of claim 16, wherein the thermal energy storage material is a gel.

19. A thermal energy storage lid for a container, comprising:

a first panel having a lid attachment element;

a second panel, offset from the first panel, having a peripheral edge connected to the first panel to form a lid compartment generally coextensive with the second panel, the second panel defining a hole, the first and second panels being formed by a polymer and being nondetachably fixed to each other, wherein the first and second panels are translucent; and a polymer tube surrounding the hole and projecting away from the lid compartment, the polymer tube forming a conduit to allow the insertion of a thermal energy storage material into the lid compartment, the polymer tube being configured to be permanently closed once the tube is sealed.

20. The thermal energy storage lid of claim 19, wherein the peripheral edge of the second panel is sealed to an extended portion of the first panel.

21. The thermal energy storage lid of claim 19, wherein the lid attachment element is generally U-shaped.

22. The thermal energy storage lid of claim 19, wherein the thermal energy storage material is a gel.

23. A method of making a thermal energy storage lid for a container, comprising:

providing first and second panels, the first panel having a lid attachment element, the second panel offset from the first panel and having a peripheral edge connected to the first panel to form a lid compartment generally coextensive with the second panel, the second panel defining a hole and including a tube surrounding the hole and projecting away from the lid compartment, the tube forming a conduit to allow the insertion of a thermal energy storage material into the lid compartment, the first and second panels being formed by a translucent polymer;

sealing the first and second panels together;

inserting a thermal energy storage material into the lid compartment through the tube, the thermal energy storage material having a color; and permanently closing the tube to seal the lid compartment maintain the thermal energy storage material between the first and second panel to provide color to the thermal energy storage lid.

24. The method of claim 23, wherein the step of closing the tube further comprises heat sealing the tube.

25. The method of claim 23, wherein the step of closing the tube further comprises sonic welding the tube.

26. The method of claim 23, wherein the peripheral edge of the second panel is sealed to an extended portion of the first panel.

27. A thermal energy storage system, comprising:

a thermal energy storage container which includes:

a first panel having a container attachment element, the first panel defining a recess for receiving food;

a second panel, offset from the first panel, having a peripheral edge connected to the first panel to form a container compartment generally coextensive with the second panel, the first and second panels being formed by a polymer and being nondetachably fixed to each other, wherein the first and second panels are translucent; and a thermal energy storage material for storage in the container compartment, the thermal energy storage material having a color that is generally viewable through the first and second panels such that the thermal energy storage container generally appears to have the color;

a thermal energy storage lid which includes:

a first panel having a lid attachment element;

a second panel, offset from the first panel, having a peripheral edge connected to the first panel to form a lid compartment generally coextensive with the second panel, the first and second panels being formed by a polymer and being nondetachably fixed to each other, wherein the first and second panels are translucent; and a thermal energy storage material for storage in the lid compartment, the thermal energy storage material having a color that is generally viewable through the first and second panels such that the thermal energy storage lid generally appears to have the color; and wherein the thermal energy storage lid is removably attached to the thermal energy storage container.

28. The thermal energy storage system of claim 27, wherein the container attachment element is flexible to form an interference friction fit with the complementary lid attachment element.

29. A method of making a thermal energy storage system, comprising:

providing a thermal energy storage container having first and second panels, the second panel being offset from the first panel, the second panel having a peripheral edge connected to the first panel to form a container compartment generally coextensive with the second panel, the first and second panels being formed by a polymer and being nondetachably fixed to each other, the second panel further defining a hole and including a tube surrounding the hole and projecting away from the container compartment, the tube forming a conduit to allow the insertion of a thermal energy storage material into the container compartment;

inserting a thermal energy storage material into the container compartment through the tube;

premanently closing the tube to seal the container compartment;

providing a thermal energy storage lid having first and second panels, the first panel including a lid attachment element, the second panel offset from the first panel and having a peripheral edge connected to the first panel to form a lid compartment generally coextensive with the second panel, the first and second panels being formed by a polymer and being nondetachably fixed to each other, the second panel defining a hole and including a tube surrounding the hole and projecting away from the lid compartment, the tube forming a conduit to allow the insertion of a thermal energy storage material into the lid compartment;

inserting a thermal energy storage material into the lid compartment through the tube;

permanently closing the tube to seal the lid compartment; and attaching the thermal energy storage lid to the thermal energy storage container.

30. The method of claim 29, wherein the step of attaching the thermal energy storage lid to the thermal energy storage container further comprises providing a flexible container attachment element to form an interference friction fit between with the complementary lid attachment element.

31. A set of stacked thermal energy storage containers, comprising:

a plurality of thermal energy storage containers, each thermal energy storage container being of a proportionately different size;

each thermal energy storage container including:

a first panel having a container attachment element, the first panel defining a recess for receiving food;

a second panel, offset from the first panel, having a peripheral edge connected to the first panel to form a container compartment generally coextensive with the second panel; and a thermal energy storage material for storage in the container compartment; and wherein the plurality of thermal energy storage containers are concentrically stacked together, wherein an insulating air barrier is formed between a base wall of the first panel of the supporting thermal energy storage containers and a base wall of the second panel of the inserted, adjacent thermal energy storage containers.

32. The set of stacked thermal energy storage containers of claim 31, wherein the first panel of each of the thermal energy storage containers includes a smoothly curved base edge adapted to support a rigidly curved base edge of the second panel of the inserted, adjacent thermal energy storage container.

33. The set of stacked thermal energy storage containers of claim 31, wherein the first panel of each thermal energy storage container includes a peripheral collar adapted to support the peripheral edge of the second panel of the inserted, adjacent thermal energy storage containers.

34. A method for making a set of stacked thermal energy storage containers, comprising:

providing a plurality of thermal energy storage containers, wherein each thermal energy storage container is of a proportionately different size; each thermal energy storage container including first and second panels, the first panel including a container attachment element, the second panel being offset from the first panel, the second panel having a peripheral edge connected to the first panel to form a container compartment generally coextensive with the second panel, the second panel further defining a hole arid including a tube surrounding the hole and projecting away from the container compartment, the tube forming a conduit to allow the insertion of a thermal energy storage material into the container compartment;

inserting a thermal energy storage material into the container compartment through the tube of each thermal energy storage container;

permanently closing the tube of each thermal energy storage container to seal the container compartment; and concentrically stacking the plurality of thermal energy storage containers, wherein an insulating air barrier is formed between a base wall of the first panel of the supporting thermal energy storage containers and a base wall of the second panel of the inserted, adjacent thermal energy storage containers.

35. A method of heating or cooling a consumable product for a desired amount of time, comprising:

providing a plurality of thermal energy storage containers, wherein each thermal energy storage container is of a proportionately different size; each thermal energy storage container including first and second panels, the second panel being offset from the first panel, the first panel including a container attachment element, the second panel having a peripheral edge connected to the first panel to form a container compartment generally coextensive with the second panel, the container compartment including a thermal energy storage material;

concentrically stacking a number of the plurality of thermal energy storage containers, the number of thermal energy storage containers in the stack depending on the desired time period for which heating or cooling is to be applied to the contents of the innermost thermal energy storage container;

providing a thermal energy storage lid having first and second panels, the first panel including a lid attachment element, the second panel offset from the first panel and having a peripheral edge connected to the first panel to form a lid compartment generally coextensive with the second panel, the lid compartment including a thermal energy storage material; and attaching a thermal energy storage lid to the innermost thermal energy storage container.

36. A thermal energy storage container, comprising:

a first panel having a container attachment element, the first panel having a first panel sidewall, a first panel bottom portion, and a first panel transition area therebetween, the first panel transition area having a generally smooth curvilinear shape;

a second panel, offset from the first panel, having a peripheral edge connected to the first panel to form a container compartment generally coextensive with the second panel, the second panel having a second panel sidewall, a second panel bottom portion, and a second panel transition area therebetween, the second panel transition area having a generally rectilinear shape; and a thermal energy storage material located within the container compartment, wherein the generally rectilinear shape of the second panel transition area maximizes the volume of the container compartment and the generally smooth curvilinear shape of the first panel transition area facilitates the flow of the thermal energy storage material during filling of the container compartment.

37. A thermal energy storage container, comprising:

a first panel having a container attachment element, the first panel having a first panel sidewall, a first panel bottom portion, and a first panel transition area therebetween, the first panel transition area having a generally smooth curvilinear shape;

a second panel, offset from the first panel, having a peripheral edge connected to the first panel to form a container compartment generally coextensive with the second panel, the second panel having a second panel sidewall, a second panel bottom portion, and a second panel transition area therebetween, the second panel transition area having a generally rectilinear shape, the second panel defining a hole; and a tube surrounding the hole and projecting away from the container compartment, the tube forming a conduit to allow the insertion of a thermal energy storage material into the container compartment, the tube being configured to be permanently closed after the tube is sealed, wherein the generally rectilinear shape of the second panel transition area maximizes the volume of the container compartment and the generally smooth curvilinear shape of the first panel transition area facilitates the flow of the thermal energy storage material during filling of the container compartment.

* * * * *